US009217266B2

(12) United States Patent
Bauman

(10) Patent No.: US 9,217,266 B2
(45) Date of Patent: Dec. 22, 2015

(54) SELF LOCATING TIE BAR GUIDE FOR SASH LOCK TIE BARS

(75) Inventor: Leonard P. Bauman, Byron, MN (US)

(73) Assignee: Truth Hardware Corporation, Owatonna, MN (US)

( * ) Notice: Subject to any disclaimer, the term of this patent is extended or adjusted under 35 U.S.C. 154(b) by 0 days.

(21) Appl. No.: 13/282,959

(22) Filed: Oct. 27, 2011

(65) Prior Publication Data

US 2012/0146342 A1 Jun. 14, 2012

Related U.S. Application Data

(60) Provisional application No. 61/407,304, filed on Oct. 27, 2010.

(51) Int. Cl.

| | |
|---|---|
| ***E05C 1/06*** | (2006.01) |
| ***E05C 9/22*** | (2006.01) |
| ***E05B 15/00*** | (2006.01) |

(52) U.S. Cl.

CPC ..... *E05C 9/22* (2013.01); *E05B 15/008* (2013.01); *Y10T 292/1014* (2015.04)

(58) Field of Classification Search

CPC . E05B 65/006; E05B 15/0006; E05B 15/008; E05C 19/06; E05C 9/22; Y10T 292/1014

USPC ..... 292/1, 251, 260, DIG. 15, DIG. 53, 292/DIG. 51, DIG. 47, DIG. 20, 80, 87, 256, 292/256.67, 300, 301, 303, 306, 340; 70/89, 90

See application file for complete search history.

(56) References Cited

U.S. PATENT DOCUMENTS

| | | | | |
|---|---|---|---|---|
| 1,385,102 | A | | 7/1921 | Winters et al. |
| 2,548,578 | A | | 4/1951 | Andersson et al. |
| 2,772,447 | A | * | 12/1956 | Preston ..... 49/464 |
| 2,866,238 | A | * | 12/1958 | Lamb ..... 49/55 |
| 2,924,476 | A | * | 2/1960 | Deane ..... 292/209 |
| 3,949,525 | A | | 4/1976 | Bates et al. |
| 4,148,106 | A | | 4/1979 | Gallien |
| 4,602,457 | A | | 7/1986 | Kreusel |
| 4,739,583 | A | | 4/1988 | Tönsmann et al. |

(Continued)

FOREIGN PATENT DOCUMENTS

CA 2364823 6/2002

OTHER PUBLICATIONS

Rejuvenation, Large Brass Casement Window Fastener 8289, www.rejuvenation.com, Mar. 3, 2005, 1 Pg.

(Continued)

*Primary Examiner* — Kristina Fulton
*Assistant Examiner* — Nathan Cumar
(74) *Attorney, Agent, or Firm* — Patterson Thuente Pedersen, P.A.

(57) ABSTRACT

A self locating tie bar guide for use with a tie bar. The tie bar guide defines a passage into which the tie bar is received. A tie bar receiving portion is shiftable between an open orientation in which the tie bar can be inserted into the passage and a closed orientation in which the tie bar is held in the passage. A resilient engaging member that engages a prelocated opening in the tie bar is resiliently biased toward the tie bar when the receiving portion is in the open orientation. The resilient tie bar engaging member is shiftable away from the tie bar when the receiving portion is in the closed orientation by contact between a portion of the resilient engaging member and another portion of the tie bar guide.

13 Claims, 6 Drawing Sheets

(56) References Cited

U.S. PATENT DOCUMENTS

| | | | | | |
|---|---|---|---|---|---|
| 4,803,808 | A | | 2/1989 | Greisner | |
| 4,980,946 | A | | 1/1991 | Verasani et al. | |
| 4,991,886 | A | | 2/1991 | Nolte et al. | |
| 5,045,265 | A | | 9/1991 | Pettit | |
| 5,087,087 | A | | 2/1992 | Vetter et al. | |
| 5,118,145 | A | | 6/1992 | Tucker | |
| 5,165,741 | A | * | 11/1992 | Everett | 292/259 R |
| 5,203,597 | A | * | 4/1993 | Wheelock | 292/258 |
| 5,370,428 | A | | 12/1994 | Dreifert et al. | |
| 5,603,538 | A | | 2/1997 | Evers | |
| 5,642,909 | A | | 7/1997 | Swan et al. | |
| 5,741,031 | A | | 4/1998 | Bauman et al. | |
| 5,778,602 | A | | 7/1998 | Johnson et al. | |
| 5,839,767 | A | | 11/1998 | Piltingsrud | |
| 5,927,767 | A | | 7/1999 | Smith et al. | |
| 6,135,511 | A | | 10/2000 | Smith et al. | |
| 6,161,881 | A | | 12/2000 | Babka et al. | |
| 6,367,853 | B1 | | 4/2002 | Briggs | |
| 6,477,810 | B2 | | 11/2002 | Van De Keuken | |
| 6,651,389 | B2 | | 11/2003 | Minter et al. | |
| 6,837,004 | B2 | | 1/2005 | Annes | |
| 7,004,515 | B2 | | 2/2006 | Timothy | |
| 7,340,860 | B2 | * | 3/2008 | Balbo Di Vinadio | 49/192 |
| 2007/0000293 | A1 | * | 1/2007 | Daniels et al. | 70/134 |

OTHER PUBLICATIONS

Ferco Corp., Fittings for tilt-turn gears JET AS 130 Aluminium joinery, 1991, 12 Pgs.

Truth Hardware, Multi-Point Locking System, *Truth Hardware Catalog*, 1993, pp. 2.7-2.7g, 8 Pgs.

Truth Hardware, Engineering Drawing 31868, Nov. 3, 1996, 1 Pg.

Truth Hardware, Mirage™ Concealed Multi-Point Locking System, *Truth Hardware Catalog*, 1996, pp. 2.5-2.5k, 12 Pgs.

Canadian Office Action dated Oct. 5, 2015 for Application No. 2,756,363 (4 pgs. total).

* cited by examiner

SELF LOCATING TIE BAR GUIDE FOR SASH LOCK TIE BARS

CLAIM TO PRIORITY

This application claims the benefit of U.S. Provisional Application 61/407,304 filed Oct. 27, 2010 entitled "Self Locating Tie Bar Guide for Sash Lock Tie Bars" which is incorporated herein by reference in its entirety.

FIELD OF THE INVENTION

The invention relates generally to locking mechanism for casement windows and doors. More specifically, the invention relates to self locating tie bar guides used to secure tie bars to the frame of a casement window or a door.

BACKGROUND

Multi point sash lock systems and multi point door lock systems are known. These systems typically have a single operating control, usually a lever or door knob. The operating control is linked to a tie bar that allows activation of the remote locking points in addition to the main locking point. Operation of the lever or knob causes the tie bar to move longitudinally, generally along the long axis of the window or the door. Tie bar guides are used to secure the tie bar to the sash or door preventing transverse movement of the tie bar while permitting the tie bar to move longitudinally.

Increasingly, self locating tie bar guides are utilized when tie bars are installed in casement windows. Self locating tie guide bars simplify the construction and assembly of casement windows and doors. Self locating tie bar guides are prepositioned at desired locations along the length of the tie bar until they are secured, typically by screws, to the sash, window frame or door. Self locating tie bar guides eliminate the need to either pre-drill holes that locate the guide securing screws or to build jigs or fixtures to hold the guides in place during the assembly process. They thus facilitate and speed assembly of the locking mechanism with the window or door.

There are several tie bar systems that have self locating tie bar guides. Self locating tie bar guides are positioned along the tie bar at predefined locations and are secured to the tie bar in such a way as to stay in position until the tie bar guides are secured to the sash and the mechanism is operated.

There are generally two types of self locating tie bar guides. First, are those that include a tab pin or some other feature that is frangible and that is broken off when the lock is operated for the first time and the tie bar is moved longitudinally. Second are those that have a detent feature that is engaged and disengaged every time the lock is operated. Each of these designs has certain short comings.

In systems that require a feature to be broken with the first operational cycle of the lock, the lock can be difficult to operate on the first cycle because sufficient force must be applied to sever the breakable feature. This is especially true when multiple locking points are used. Very often, the first operator of the lock is a homeowner. Homeowners commonly assume that there is something wrong with the window when it is difficult to operate the lock mechanism the first time. Alternately, they may believe that a part of the lock mechanism not intended to break has been broken when they initially operate the lock. This can lead to increased warranty claims and dissatisfaction on the part of the homeowner.

An additional concern that arises with systems that have a breakable feature, is that a broken off piece, when it is separated, can become free and lodge in some moving part of the lock mechanism. This can cause binding, noise or other problems which can also lead to increased warranty claims and homeowner dissatisfaction.

In the case of systems that have a permanent detent feature which engages and disengages every time the lock is operated, the detent can be felt every time the locked is cycled. This prevents smooth operation of the lock hardware which is generally desirable.

One example of prior art breakaway pin designs includes a tab on a plastic tie bar guide that engages in a notch on the steel tie bar to position the guide. The tab breaks away when the lock is first cycled. Another example of a prior art tie bar system uses a small tab to hold a t-shaped guide into a c-shaped tie bar. When the tie bar guide is secured with a screw, a shoulder of the mounting screw pushes the location tab into a recess in the tie bar guide. This allows the tie bar to slide freely once installed.

Another prior art approach uses a leg with a post that fits into a hole in the tie bar guide. When the lock is first cycled, the post is forced out of the hole by movement of the tie bar and forces the leg upward. This causes the leg to yield or break at a weak point built into the leg. After the material of the leg has yielded, there is no downward pressure on the post and the post does not reengage into the hole, thereby freeing the tie bar for use. Another prior art device includes a dual tie bar guide with a breaking tab. The tab is fastened to the tie bar at a lock roller rivet. When the lock is operated for the first time, two small attachment points break allowing the tie bar to travel freely. The tab remains attached to the tie bar.

Accordingly, there is still room for improvement in the design of self locating tie bar guides.

SUMMARY OF THE INVENTION

The invention solves many of the above discussed problems by providing a self locating tie bar guide that has a locating tongue that holds the guide in place on the tie bar prior to installation. The locating tongue releases when the guide is secured to the frame. No parts are broken during the release. The release of the tongue permits free operation of the tie bar. The present invention does not require the lock to be cycled to release or break the locating tab. This allows free movement of the lock from the very first cycle. In addition, there are no broken or frangible pieces produced that can lodge in and interfere with operation of the locking mechanism.

The tie bar guide according to an embodiment of the invention has a generally u-shaped design which allows it to be snapped onto a tie bar. The open end of the u-shape is smaller than the thickness of the tie bar. This prevents the tie bar guide from falling off the tie bar prior to installation. In the center of an example tie bar guide is a tongue with a roughly hemispherical bump on its tip that engages an opening in the tie bar. This prevents the tie bar guide from sliding along the length of the tie bar prior to installation. The tongue is attached at its base to one side of the u-shaped tie bar guide. Near the base of the tongue is a short leg extending perpendicularly outward from the tongue. When mounting screws are inserted and tightened, the U-shaped guide is forced closed. As the guide closes the leg under the tongue contacts an opposing wall of the u-shaped tie bar guide thus forcing the tongue away from the tie bar and lifting the hemispherical bump at the tip of the tongue out of the hole in the tie bar.

In a typical installation, two or more tie bar guides are located along the length of a tie bar prior to installation. The holes in the tie bar are located so that the self locating tie bar guides are at desired locations along the length of the tie bar for installation. The tie bar is then placed against the installation surface to which it will be attached and screws are inserted through openings in each of the tie bar guides to secured to the tie bar guides to the window sash or door frame. Tightening of the screws causes the leg to contact the opposite wall of the tie bar guide forcing the tongue away from the tie bar and releasing the hemispherical bump from the hole in the tie bar thereby releasing the tie bar for free longitudinal movement relative to the tie bar guide.

The invention includes a self locating tie bar guide for use with a tie bar of a locking mechanism having prelocated openings located thereon, the tie bar guide including: a unitary body comprising a tie bar receiving portion, a locator engaging portion and a fastener receiving portion. The tie bar receiving portion is shiftable between an open orientation in which the tie bar can be inserted transversely into the tie bar receiving portion and a closed orientation in which the tie bar is held transversely in the tie bar receiving portion. The tie bar receiving portion defines a longitudinal passage therethrough, the passage being sized and shaped, when in the closed orientation, to engage the tie bar in close apposition while permitting longitudinal movement of the tie bar therein. The locator engaging portion including a resilient tie bar engaging member that engages at least one of the prelocated openings when the tie bar receiving portion is in the open orientation and that is resiliently biased toward and into the tie bar passage when the tie bar receiving portion is in the open orientation and is shifted away from the tie bar passage and disengaged from the at least one of the prelocated openings when the tie bar receiving portion is in the closed orientation. The fastener receiving portion defines at least one aperture therethrough and being oriented such that a received fastener passing therethrough abuts at least part of the fastener receiving portion and urges the tie bar receiving portion toward the closed position.

The invention also includes a tie bar assembly for use with a window or door locking assembly, including: a tie bar having a plurality of prelocated openings located thereon; at least one tie bar guide as described herein releasably secured to the tie bar at one of the plurality of prelocated openings.

DETAILED DESCRIPTION

Figure 1:
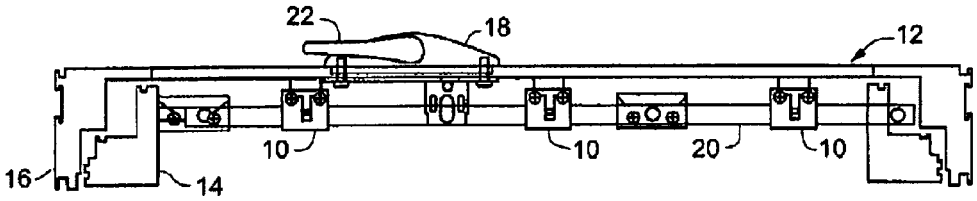
FIG. 1 is cross sectional view of casement window including three self locating tie bar guides according to an embodiment of the invention.

Referring to FIG. 1, self locating tie bar guide 10 according to the invention is typically used with a casement window assembly 12. A casement window assembly generally includes sash 14 and frame 16. Sash 14 can be secured to frame 16 when sash 14 is closed by activation of locking mechanism 18. Locking mechanism 18 includes tie bar 20. Tie bar 20 is slidably moveable to actuate locking mechanism 18 when handle 22 is manipulated.

Self locating tie bar guide 10 is temporarily secured to tie bar 20 at desired locations by its interaction with an aperture (not shown in FIG. 1, see FIGS. 6 and 7) located in tie bar 20. Locator engaging portion 45 engages at least one of the prelocated openings when the tie bar receiving portion is in the open orientation.

Figure 2:
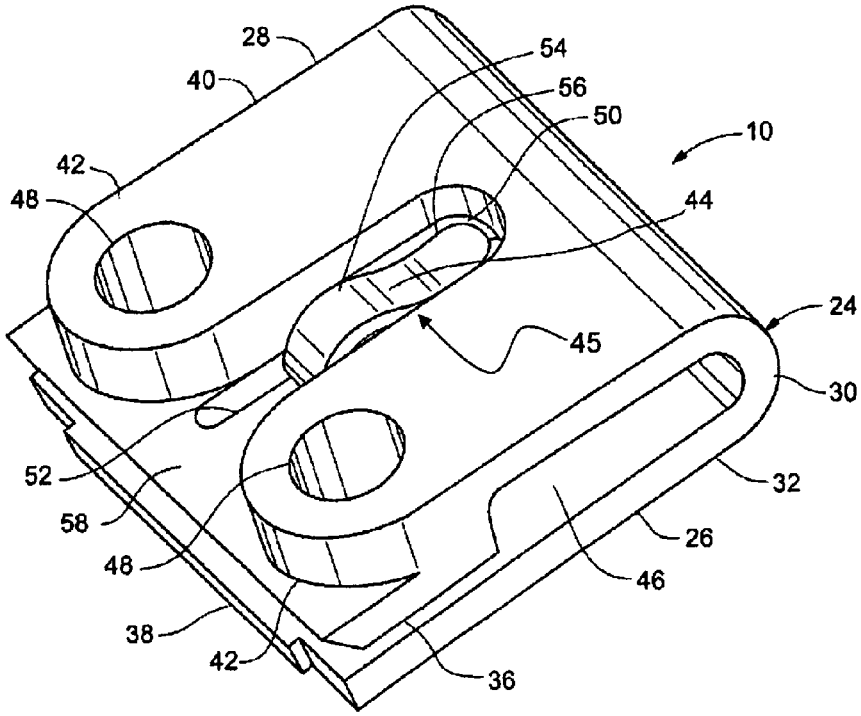
FIG. 2 is a perspective view of a self locating tie bar guide according to an embodiment of the invention.
Figure 3:
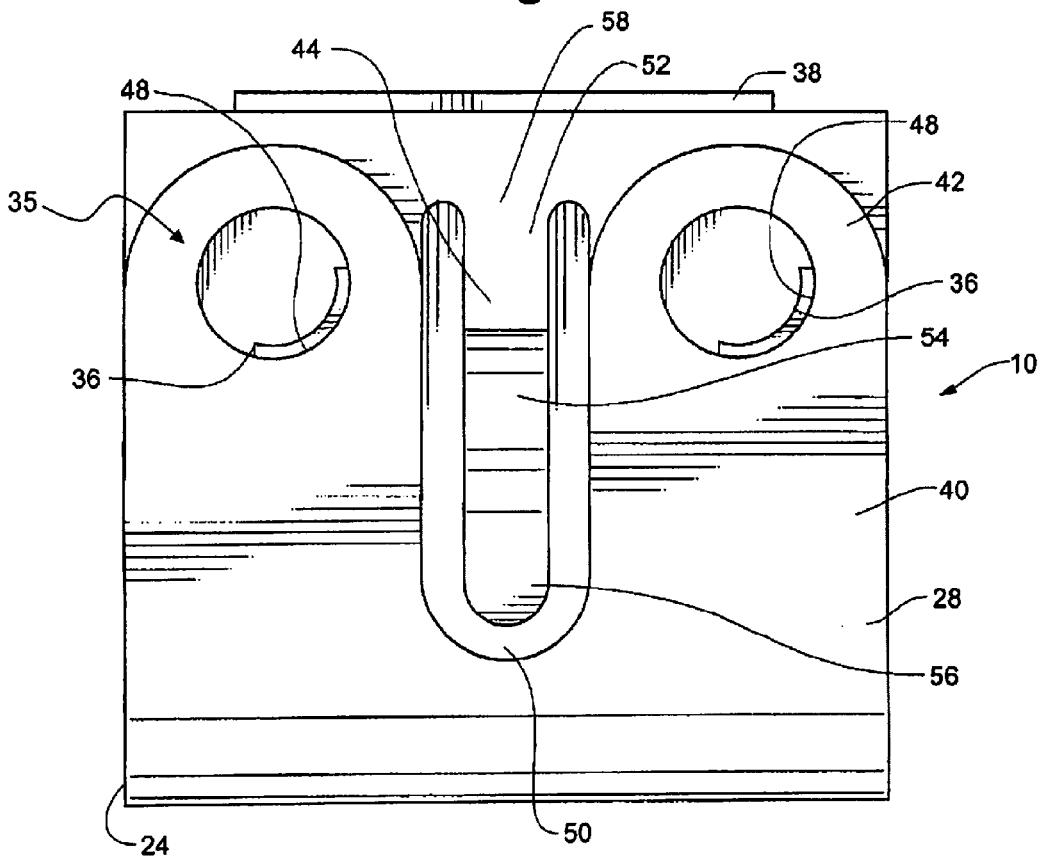
FIG. 3 is plan view of a self locating tie bar guide according to an embodiment of the invention.
Figure 4:
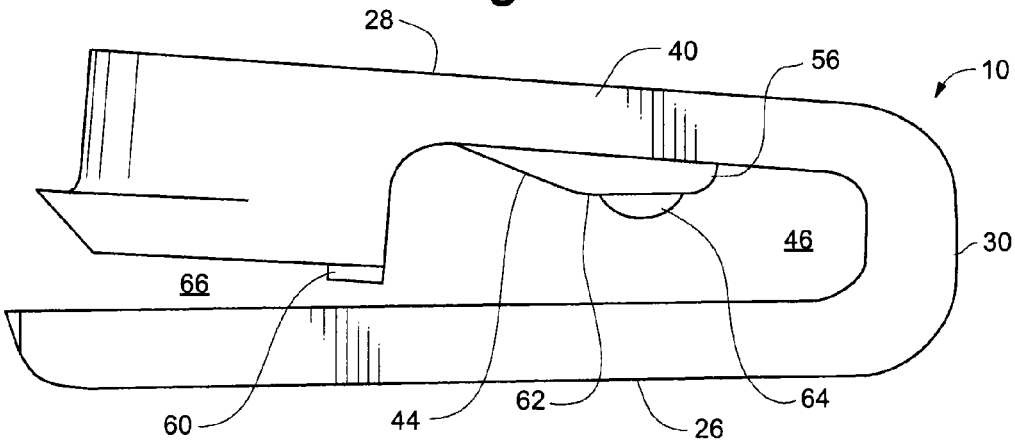
FIG. 4 is a cross sectional view of a self locating tie bar guide according to an embodiment of the invention.

According to an embodiment of the invention depicted in FIGS. 2, 3 and 4, tie bar guide 10 generally includes unitary body 24 having lower plate 26, upper portion 28 and c-shaped portion 30. Lower plate 26 is joined to upper portion 28 by c-shaped portion 30. Tie bar guide 10 may be formed, for example, of a polymer by a molding process or from resilient metal.

Lower plate 26 generally includes planar mounting plate 32, defining screw mounting apertures 36. Lower plate 26 may further include extension 38.

Upper portion 28 generally includes tie bar bridge 40, screw bosses 42 and tongue portion 44. Tie bar bridge 40 extends between c-shaped portion 30 and screw bosses 42 and may be divided by tongue portion 44 as depicted in FIGS. 2 and 3.

Figure 6:
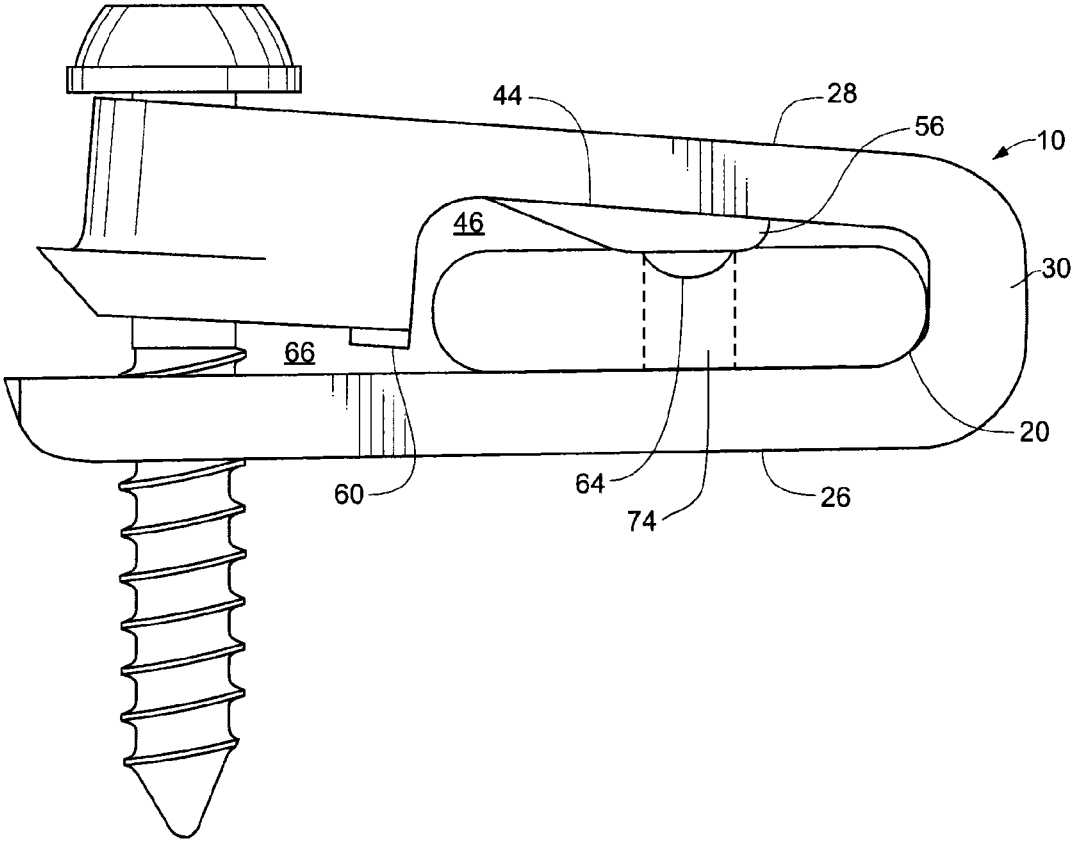
FIG. 6 is a cross sectional view of an uninstalled self locating tie bar guide secured to a tie bar according to an embodiment of the invention.

Lower plate 26, upper portion 28 and c-shaped portion 30 together define and surround tie bar passage 46 as can be seen in FIG. 4. Tie bar passage 46 is sized to slidably receive tie bar 20 therein as can be seen in FIG. 6. Tie bar passage 46 is sized and shaped to permit sufficient freedom of movement for tie bar 20, once installed on a window or door, to longitudinally slide while holding tie bar 20 substantially in a transverse position with minimal transverse movement.

In the embodiment depicted in FIGS. 2-4, screw bosses 42 define upper screw mounting apertures 48 of the fastener receiving portion 35. Upper screw mounting apertures 48 are aligned with screw mounting apertures 36 so that a screw or other fastener (not shown) inserted therethrough passes through both upper screw mounting apertures 48 and screw mounting apertures 36 to secure tie bar guide 10 to sash 14.

In this example embodiment, tongue portion 44 is positioned within tongue opening 50, which is formed through upper portion 28 and tie bar bridge 40. Tongue portion 44 includes tongue support 52, tongue arch 54 and tongue end 56. Tongue support 52 supports tongue arch 54, which in turn supports tongue end 56. Tongue support 52 extends into tongue opening 50 from recessed portion 58, which in this example embodiment is located generally between screw bosses 42.

Referring particularly to FIG. 2 and FIG. 4, in the depicted example embodiment, tongue arch 54 rises above tongue support 52 and tongue end 56.

Referring particularly to FIG. 4, tongue support 52 presents tongue leg 60, which extends downwardly toward lower plate 26 when tie bar guide 10 is in an open orientation and not secured by fasteners. On the underside thereof, tongue end 56 presents plateau 62 and tie bar engaging bump 64. Tie bar engaging bump 64 may have a hemispherical or partially spherical shape as depicted in FIG. 4 or another shape. When in a relax state or open orientation, in this example embodiment, self locating tie bar guide 10 presents gap 66 between lower plate 26 and upper portion 28 in the vicinity of screw bosses 42.

Figure 5:
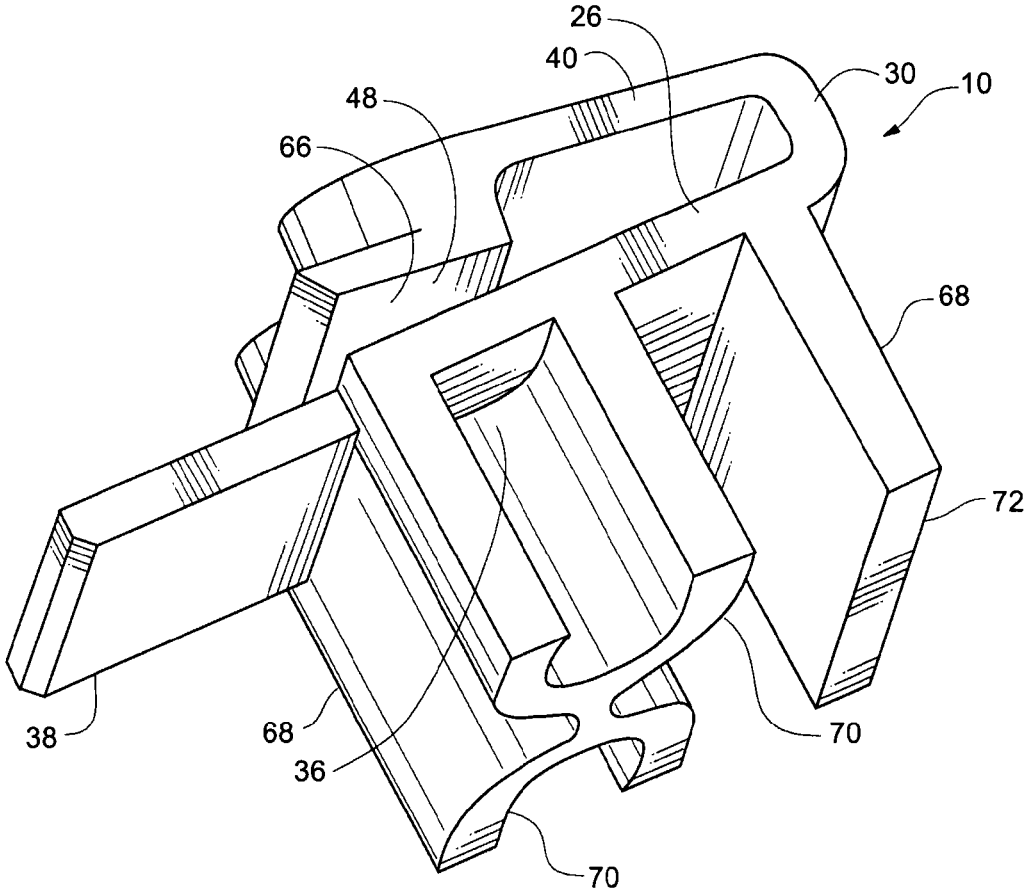
FIG. 5 is a perspective view of a self locating tie bar guide according to an embodiment of the invention including extended supports.

Referring to FIG. 5, tie bar guide 10 in accordance with another embodiment of the invention, may include locating legs 68 extending outwardly away from lower plate 26. Locating legs 68 may include u-shaped locating legs 70 and/or linear locating leg 72 as depicted in FIG. 5. Locating legs 68 may assume other shapes as well.

Referring to FIG. 6, a cross sectional view of tie bar guide 10 is shown along with tie bar 20. Tie bar engaging bump 64 is engaged in opening 74 of tie bar 20.

Figure 7:
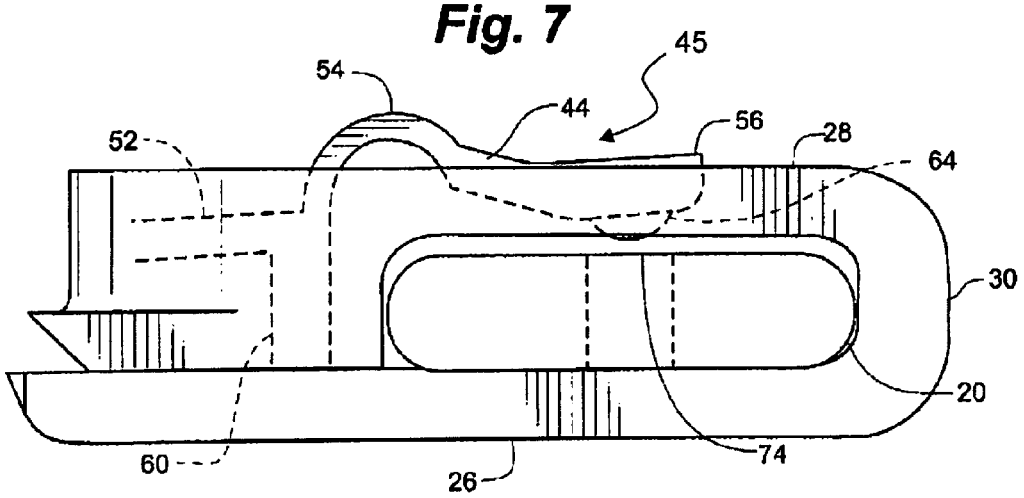
FIG. 7 is a cross sectional schematic view of an installed self locating tie bar guide including a tie bar that has been freed according to an embodiment of the invention.

Referring to FIG. 7, a schematic cross sectional view of tie bar guide 10 after it has been secured, with screws or other fasteners (not shown), is depicted along with tie bar 20. Here tie bar guide 10 is depicted in a closed orientation. As depicted, upper portion 28 has been brought into contact with planar mounting plate 32. Accordingly, tongue leg 60 has contacted planar mounting plate 32, thus forcing tongue portion 44 upward so that tie bar engaging bump 64 has been disengaged from opening 74 in tie bar 20. Thus, tie bar 20, while being generally secured transversely, is free to move longitudinally with minimal friction by sliding within tie bar passage 46.

In operation, at least one self locating tie bar guide 10 is placed onto tie bar 20 by inserting tie bar 20 transversely through gap 66 and into tie bar passage 46. Alternately, tie bar guide 10 can be slid onto tie bar 20 longitudinally from one end of tie bar 20. Tie bar guide 10 is then slid along tie bar 20 until tie bar engaging bump 64 engages opening 74 in tie bar 20. As many tie bar guides 10 are desired are placed onto tie bar 20 at prelocated openings 74. Tie bar 20 is provided with at least as many openings 74 along its length as the desired number of tie bar guides 10 that it is desired to use to secure tie bar guides 10 along the length thereof. Openings 74 are located at the desired locations of tie bar guides 10 relative to tie bar 20 when tie bar 20 is secured to casement window assembly 12.

Tie bar 20 with self locating tie bar guides 10 thereon is then placed against a sash 14 in a desired mounting location.

Referring to FIGS. 6 and 7, mounting screws (not shown) are inserted through upper screw mounting apertures 48 and screw mounting apertures 36 and tightened by driving them into sash 14, or other desired mounting location. As screws (not shown) are tightened, upper portion 28 of tie bar 10 is drawn toward lower plate 26 of tie bar guide 10. During this process c-shaped portion 30 and tie bar bridge 40 flex. As upper portion 28 is drawn against lower plate 26, tongue leg 60 contacts lower plate 26 and is forced upward relative to upper portion 28 against the resilient bias of tongue support 52 and tongue arch 54. At the same time, tie bar engaging bump 64 on tongue end 56 is lifted out of opening 74 in tie bar 20. Once tie bar engaging bump 64 is disengaged from opening 74, tie bar 20 is free to slide longitudinally within tie bar passage 46. Thereafter, when locking mechanism 18 is actuated by the movement of handle 22, smooth unrestricted operation is achieved immediately from the first operational cycle. Further, no broken off parts are released that can possibly become lodged in locking mechanism 18 and interfere with its proper and unrestricted operation.

The present invention may be embodied in other specific forms without departing from the spirit of the essential attributes thereof; therefore, the illustrated embodiments should be considered in all respects as illustrative and not restrictive, reference being made to the appended claims rather than to the foregoing description to indicate the scope of the invention.

The invention claimed is:

1. A self locating tie bar guide for use with a tie bar of a locking mechanism for a window, the tie bar having prelocated openings located thereon, the tie bar guide comprising: a unitary body comprising a tie bar receiving portion, a locator engaging portion and a fastener receiving portion; the tie bar receiving portion comprising an upper portion and an opposing lower plate joined by a c-shaped portion, the upper portion being shiftable relative to the lower plate between an open orientation in which the tie bar can be inserted into the tie bar receiving portion through a gap defined between the upper portion and the lower plate and a closed orientation in which the upper portion contacts the lower plate to prevent tie bar from passing through the gap; the tie bar receiving portion defining a longitudinal passage there through, the passage being sized and shaped, when in the closed orientation, to slidably receive the tie bar therein; the locator engaging portion including a resilient tie bar engaging member that engages at least one of the prelocated openings when the tie bar receiving portion is in the open orientation and that is resiliently biased toward and into the tie bar passage when the tie bar receiving portion is in the open orientation and is shifted away from the tie bar passage and disengaged from the at least one of the prelocated openings when the tie bar receiving portion is in the closed orientation, wherein the resilient tie bar engaging member further includes a tongue portion including a tie bar engaging bump, wherein the tie bar engaging bump is sized and shaped to engage at least one of the prelocated openings when the tie bar receiving portion is in the open orientation, wherein the tongue portion includes a tongue leg spaced apart from the lower plate when the tie bar receiving portion is in the open orientation and being in contact with the lower plate when the tie bar receiving portion is in the closed orientation, and wherein contact of the tongue leg with the lower plate shifts the tie bar engaging bump out of engagement with the prelocated opening; and the fastener receiving portion defining at least one aperture there through and being oriented such that a received fastener passing there through abuts at least part of the fastener receiving portion and urges the tie bar receiving portion toward the closed position when the fastener is tightened.

2. The self locating tie bar guide as claimed in claim 1, wherein the tongue leg is coupled to a tongue support and wherein the tongue support is resiliently, displaceably coupled to the upper portion.

3. The self locating tie bar guide as claimed in claim 1, wherein the fastener receiving portion includes screw bosses having at least one upper screw mounting aperture defined therethrough and a lower plate having at least one lower screw mounting aperture therethrough, the upper screw mounting apertures and the lower screw mounting apertures being substantially axially aligned and separated by a space when the tie bar receiving portion is in the open orientation.

4. The self locating tie bar guide as claimed in claim 1, wherein the resilient tie bar engaging member further comprises a tongue portion.

5. The self locating tie bar guide as claimed in claim 4, wherein the tongue portion further comprises a tongue support, a tongue arch and a tongue end the tongue support being coupled to the tie bar engaging portion, the tongue arch extending from the tongue support and the tongue end extending from the tongue arch.

6. The self locating tie bar guide as claimed in claim 1, wherein the unitary body is formed from a polymeric material.

7. A tie bar assembly for use with a window or door locking assembly, comprising: a tie bar having a plurality of prelocated openings located thereon; at least one tie bar guide releasably secured to the tie bar at one of the plurality of prelocated openings; the tie bar guide comprising a unitary body comprising a tie bar receiving portion, a locator engaging portion and a fastener receiving portion; the tie bar receiving portion comprising an upper portion and an opposing lower plate joined by a c-shaped portion, the upper portion being shiftable relative to the lower plate between an open orientation in which the tie bar can be inserted into the tie bar receiving portion through a gap defined between the upper portion and the lower plate and a closed orientation in which the upper portion contacts the lower plate to prevent the tie bar from passing through the gap; the tie bar receiving portion defining a longitudinal passage there through, the passage being sized and shaped, when in the close d orientation, to slidably receive the tie bar therein; the locator engaging portion including a resilient tie bar engaging member that engages at least one of the prelocated openings when the tie bar receiving portion is in the open orientation and that is resiliently biased toward and into the tie bar passage when the tie bar receiving portion is in the open orientation and is shifted away from the tie bar passage and disengaged from the at least one of the prelocated openings when the tie bar receiving portion is in the closed orientation, wherein the resilient tie bar engaging member further includes a tongue portion including a tie bar engaging bump, wherein the tie bar engaging bump is sized and shaped to engage at least one of the prelocated openings when the tie bar receiving portion is in the open orientation, wherein the tongue portion includes a tongue leg spaced apart from the lower plate when the tie bar receiving portion is in the open orientation and being in contact with the lower plate when the tie bar receiving portion is in the closed orientation, and wherein contact of the tongue leg with the lower plate shifts the tie bar engaging bump out of engagement with the prelocated opening; and the fastener receiving portion defining at least one aperture therethrough and being oriented such that a received fastener passing there through abuts at least part of the fastener receiving portion and urges the tie bar receiving portion toward the closed position when the fastener is tightened.

8. The tie bar assembly as claimed in claim 7, wherein the tongue leg is coupled to a tongue support and wherein the tongue support is resiliently, displaceably coupled to the upper portion.

9. The tie bar assembly as claimed in claim 7, wherein the fastener receiving portion includes screw bosses having at least one upper screw mounting aperture defined therethrough and a lower plate having at least one lower screw mounting aperture therethrough, the upper screw mounting apertures and the lower screw mounting apertures being substantially axially aligned and separated by a space when the tie bar receiving portion is in the open orientation.

10. The tie bar assembly as claimed in claim 7, wherein the resilient tie bar engaging member further comprises a tongue portion.

11. The tie bar assembly as claimed in claim 10, wherein the tongue portion further comprises a tongue support, a tongue arch and a tongue end the tongue support being coupled to the tie bar engaging portion, the tongue arch extending from the tongue support and the tongue end extending from the tongue arch.

12. The tie bar assembly as claimed in claim 7, wherein the resilient tie bar engaging member is disengaged from the at least one of the prelocated openings by interference with another portion of the unitary body when the tie bar receiving portion is shifted from the open orientation to the closed orientation.

13. The tie bar assembly as claimed in claim 7 wherein the unitary body is formed from a polymeric material.

* * * * *